US006214181B1

(12) United States Patent
Iacopetti et al.

(10) Patent No.: US 6,214,181 B1
(45) Date of Patent: Apr. 10, 2001

(54) ION EXCHANGE MEMBRANE BIPOLAR ELECTROLYZER

(75) Inventors: Luciano Iacopetti, Pieve Emanuele; Maurizio Marzupio, Capriate S. Gervasio, both of (IT)

(73) Assignee: De Nora S.p.A. (IT)

( * ) Notice: Subject to any disclaimer, the term of this patent is extended or adjusted under 35 U.S.C. 154(b) by 0 days.

(21) Appl. No.: 09/424,944

(22) PCT Filed: Jun. 2, 1998

(86) PCT No.: PCT/EP98/03286

§ 371 Date: Dec. 22, 1999

§ 102(e) Date: Dec. 22, 1999

(87) PCT Pub. No.: WO98/55670

PCT Pub. Date: Dec. 10, 1998

(30) Foreign Application Priority Data

Jun. 3, 1997 (IT) ..... MI97A1296
Apr. 29, 1998 (IT) ..... MI98A0915

(51) Int. Cl.[7] ..... C25B 9/00

(52) U.S. Cl. ..... 204/256; 204/252; 204/254; 204/255; 204/257; 204/258; 204/263; 204/266; 204/279

(58) Field of Search ..... 204/252, 254, 204/255, 256, 257, 258, 279, 263, 266, 268, 270; 205/616, 620, 622

(56) References Cited

U.S. PATENT DOCUMENTS

| | | | | |
|---|---|---|---|---|
| 3,902,984 | * | 9/1975 | Yoshida et al. | 204/253 |
| 4,557,816 | * | 12/1985 | Yoshida et al. | 204/255 |
| 4,602,984 | * | 7/1986 | Beaver et al. | 204/279 |
| 4,643,818 | * | 2/1987 | Seko et al. | 204/255 |
| 4,666,580 | * | 5/1987 | Beaver et al. | 204/254 |
| 4,734,180 | * | 3/1988 | Sato et al. | 204/254 |
| 4,755,272 | * | 7/1988 | Plowman | 204/256 |
| 4,839,012 | * | 6/1989 | Burney, Jr. et al. | 204/255 |
| 5,174,878 | * | 12/1992 | Wüllenbueber et al. | 204/254 |
| 5,314,591 | * | 5/1994 | Katayama et al. | 204/257 |
| 5,372,692 | * | 12/1994 | Sakamoto et al. | 204/268 |
| 5,484,514 | * | 1/1996 | Katayama | 204/256 |
| 5,571,390 | * | 11/1996 | Kimura et al. | 204/256 |

FOREIGN PATENT DOCUMENTS

| | | |
|---|---|---|
| 0612865 | 8/1994 | (EP) . |
| 0625591 | 11/1994 | (EP) . |

* cited by examiner

*Primary Examiner*—Bruce F. Bell
(74) *Attorney, Agent, or Firm*—Bierman, Muserlian and Lucas

(57) ABSTRACT

The present invention discloses a new design of elements for ion exchange membrane electrolyzers for the electrolysis of brine to produce chlorine, hydrogen and caustic soda. This new design solves the problems affecting prior art, by both minimizing the electrolyte concentration and temperature gradients, and the pressure fluctuation resorting to components which are easy to be installed and may be obtained through automated production cycles.

28 Claims, 11 Drawing Sheets

ION EXCHANGE MEMBRANE BIPOLAR ELECTROLYZER

Figure 1:
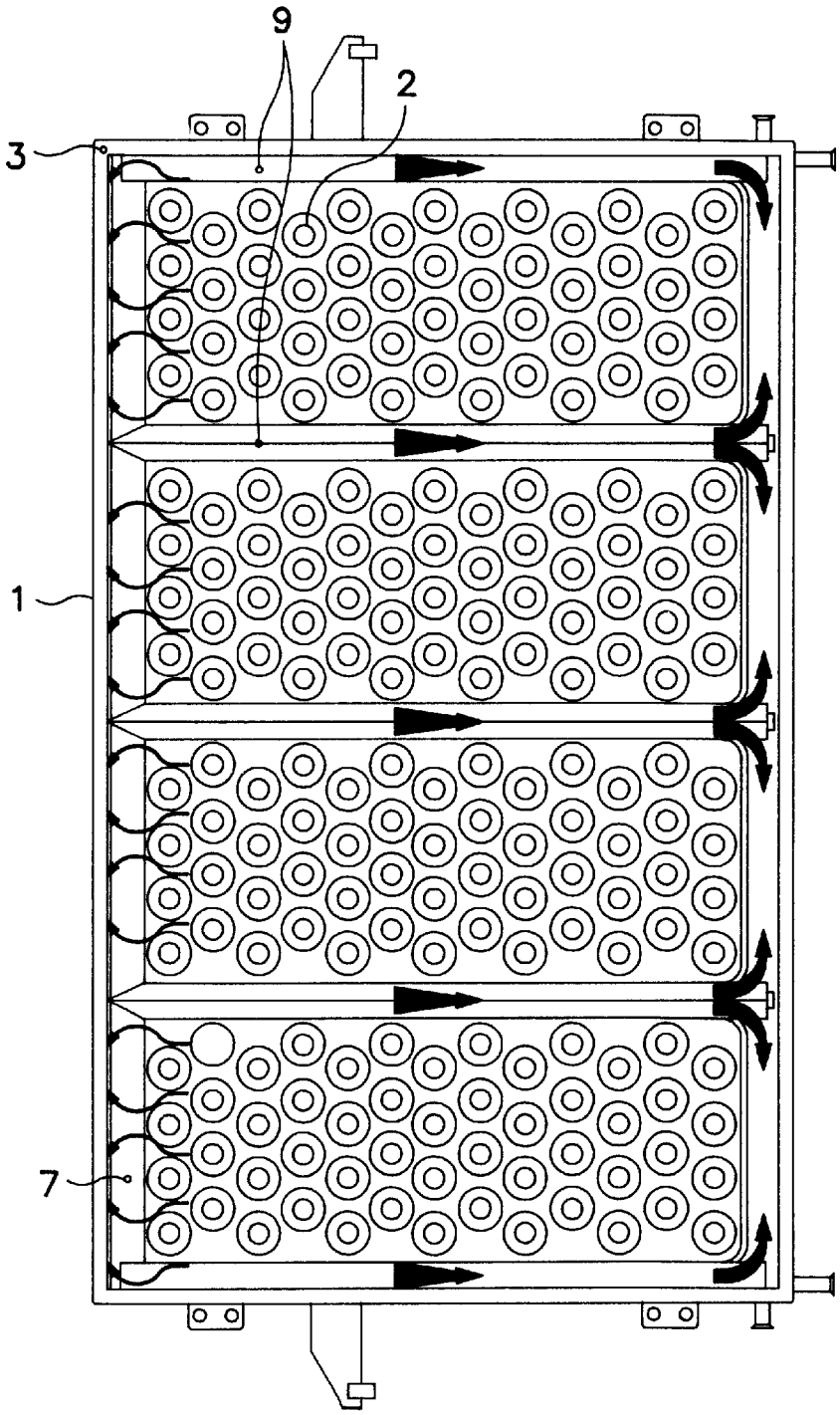

This application is a 371 PCT/EP98/03286 filed Jun. 2, 1998.

DESCRIPTION OF THE PRIOR ART

Today chlorine and caustic soda are industrially produced in plants based on the mercury cathode, diaphragm or ion-exchange membrane technologies. While the first two technologies are considered fully developed and only marginal improvements may be foreseen, the third one, much more recent, is the only one used in, grass-roots plants and is under continuous evolution. The modifications made in the last times are substantially directed to obtain lower energy consumption, reduced investment costs, and to solve typical problems affecting this technology, such as:

U.S. Pat. No. 4,340,452 describes an internal structure of the electrolyzer, the so-called "zero gap" configuration, wherein the anodes and the cathode, separated by an ion exchange membrane, are pressed to each other. In this way the anode-cathode gap, which directly influences the energy consumption, is represented by the membrane only. This results is obtained by resorting to an expensive electrode structure (flexible mesh and resilient metal mattress).

U.S. Pat. No. 4,655,886 discloses a membrane having microporous hydrophilic films applied to both surfaces thereof, which prevent the gas bubbles (hydrogen on the cathode side and chlorine on the anode side) from sticking to the membrane. In this way all the membrane surface is kept in contact with the electrolytes, thus avoiding dangerous current concentrations which would increase the energy consumption.

U.S. Pat. No. 4,488,946 discloses a structure of the elements provided with projections obtained by hot or cold forming. The electrodes are connected to said projections without any spacer interposed inbetween. The use of spacers, described for example in U.S. Pat. No. 4,111,779 involves an additional complex production step which makes the structure more expensive. The concept disclosed in U.S. Pat. No. 4,488,946 of eliminating the spacers is found also in U.S. Pat. No. 5,314,591.

The structure described in U.S. Pat. Nos. 4,488,946 and 5,314,591 involves however the possibility that the electrodes connected to the projections may cause the formation of occluded areas wherein gas pockets could accumulate and hinder current flow and damage the membranes. Further, the elements provided with projects as described in U.S. Pat. Nos. 4,488,946 and 5,314,591 hinder the electrolyte circulation and in particular the internal mixing.

Various solutions have been suggested:

U.S. Pat. No. 4,294,671 describes an electrode made of a thick mesh having large openings, cold pressed to form dimples. The dimples are the points where the screen is fixed to the projections of the elements. Subsequently on said screen an additional fine screen provided with an electrocatalytic coating is applied to form the electrode. The production, i.e. pressing and connection, is automated and therefore the cost increase is given only by the fine screen.

U.S. Pat. No. 5,372,692 teaches the introduction of spacers to be applied on the upper part of the projections of the element wall. This procedure may be automated and is less expensive than the one disclosed in U.S. Pat. No. 4,111,779 but still remains very complicated and delicate due to the need of a correct positioning of a high number of spacers whereon the electrode is subsequently fixed.

The second problem, that is insufficient internal mixing of the electrolytes is solved in U.S. Pat. No. 5,314,591 by the introduction of a lower distributor, an upper collector and an offset positioning of the projections. This solution is certainly very delicate as the occlusion of even a few holes in the distributors and collectors could lead to important variations of the electrolyte concentration which, even if localized, certainly would damage the ion exchange membranes. Further the solution described in U.S. Pat. No. 5,314,591 can ensure homogeneity of the electrolyte concentration in a horizontal plane (that is along a plane perpendicular to the upward motion), but certainly is totally ineffective as to the concentration in the vertical direction. To keep said concentrations within acceptable limits for the membranes, large electrolyte flows are necessary, which means external pumps of large dimensions with the consequent increased energy consumption. It must be considered that the same applies to temperature. Today these considerations regarding concentration and temperature gradients are more important than in the past with the modern commercial membranes which are characterized by low ohmic drops and are thus capable of decreasing the operating voltage of the electrolyzers and therefore the specific energy consumption. These membranes are particularly sensitive to impurities in the electrolytes, as well as to concentration and temperature gradients. Under this point of view, in conclusion, the devices described in U.S. Pat. No. 5,314,591 cannot be considered as particularly efficient.

An alternative solution consists in ensuring a very high flow rate by means of gas disengagers positioned above the electrolyzer and connected to the electrolyte inlet by means of downcomers ("Modern Chlor-Alkali Technology", Vol. 5, Society of Chemical Industry, Elsevier 1992, page 93).

This system is very efficient but involves additional costs and in particular large dimensions of the electrolyzer-gas disengager-downcomers assembly, which are often incompatible with the available room in the plants.

An alternative system is illustrated in U.S. Pat. No. 4,557,816 wherein the elements are provided with an internal downcomer connected to a lower distributor. This device represents a partial solution of the problem of homogenizing the electrolytes as the limited cross section of the gas-free liquid flow does not permit a high recirculation speed.

A further delicate problem to be faced is the discharge of the gas-electrolyte mixture from the electrolyzer elements. An improper geometry causes pressure pulsations and consequently vibrations and abrasion of the delicate membrane. U.S. Pat. No. 5,242,564 solves this problems by means of a double discharge duct which, if suitably designed, discharges the electrolytes and the gases as separate phases. This solutions obviously involves higher production costs and a higher number of delicate items which could be the source of defects, such as the elements/discharge ducts welding area.

U.S. Pat. No. 4,839,012 is not directed to solving the problem of pressure pulsations caused by a single outlet duct positioned in the upper side of the elements but rather dampening their transmission inside the elements, to the membranes. This result is obtained by the positioning inside the elements of a perforated tube. The holes, having a suitable diameter, dampen the pressure pulsations generated in the areas close to the outlet ducts.

A further solution is represented by the downcoming discharge duct described in "Modern Chlor-Alkali Technology", Vol. 4, Society of Chemical Industry, Elsevier 1990, page 171. In this case a single downcoming duct, either external or inside the elements, collects at the same time gas and electrolytes without causing internal pressure pulsations. In fact, in the absence of an uprising vertical path, in the electrolyte there is no separation of gas bubbles, varying as to the dimensions and number with time (first cause of the problem) but rather a downcoming motion of the liquid along the walls of the downcoming duct and an undisturbed gas flow in the central section of the duct not occupied by the liquid. These devices, however, perform satisfactorily only when the upper side of the downcoming duct is continuously and uniformly fed by a gas-free electrolyte and a gas phase entrapping only small drops of liquid. Therefore the gas-electrolyte mixture produced by the electrodes must be efficiently separated in the upper portion of the elements before being fed to the downcoming ducts.

DESCRIPTION OF THE INVENTION

The present invention discloses a new design of elements for ion exchange membrane electrolyzers for the electrolysis of brine to produce chlorine, hydrogen and caustic soda. This new design solves the problems affecting prior art, by both minimizing the electrolyte concentration and temperature gradients, and the pressure fluctuation resorting to components which are easy to be installed and may be obtained through automated production cycles. The following description will make reference to elements suitable for assembly in a bipolar electrolyzer of the type described in U.S. Pat. No. 4,488,946. However, with the modifications described in U.S. Pat. No. 4,602,984, the same elements may be also utilized in monopolar electrolyzers.

The design of the present invention was obtained by assimilating the electrolyzer elements to perfectly stirred reactors known in the art as CSTR. Such a condition leads to a substantially complete uniformity of the concentration and temperature of the electrolyte bulks, both in the vertical and lateral direction. In order to maintain this uniformity also at the membrane interface, the electrode geometry must provide for a strong local recirculation, which may be induced by the evolution of the produced gas, hydrogen on the cathode side and chlorine on the anode side of each electrolyzer element respectively. Further, in order to obtain the necessary homogeneity of concentration and temperature at the membrane interface, the current distribution must be uniform, which in turn requires a suitable distance among the various contact points between the electrodes and the element structure and a sufficient transversal electrical conductivity of the electrodes. This last parameter is a function of the electrode thickness and of the void ratio defined by the size of the openings of the electrode, which may be a foraminous sheet or mesh.

BRIEF DESCRIPTION OF THE INVENTION

The invention will be illustrated making reference to the drawings, wherein:

FIG. 1 is a front cross-section of the electrolyzer of the invention

Figure 2:
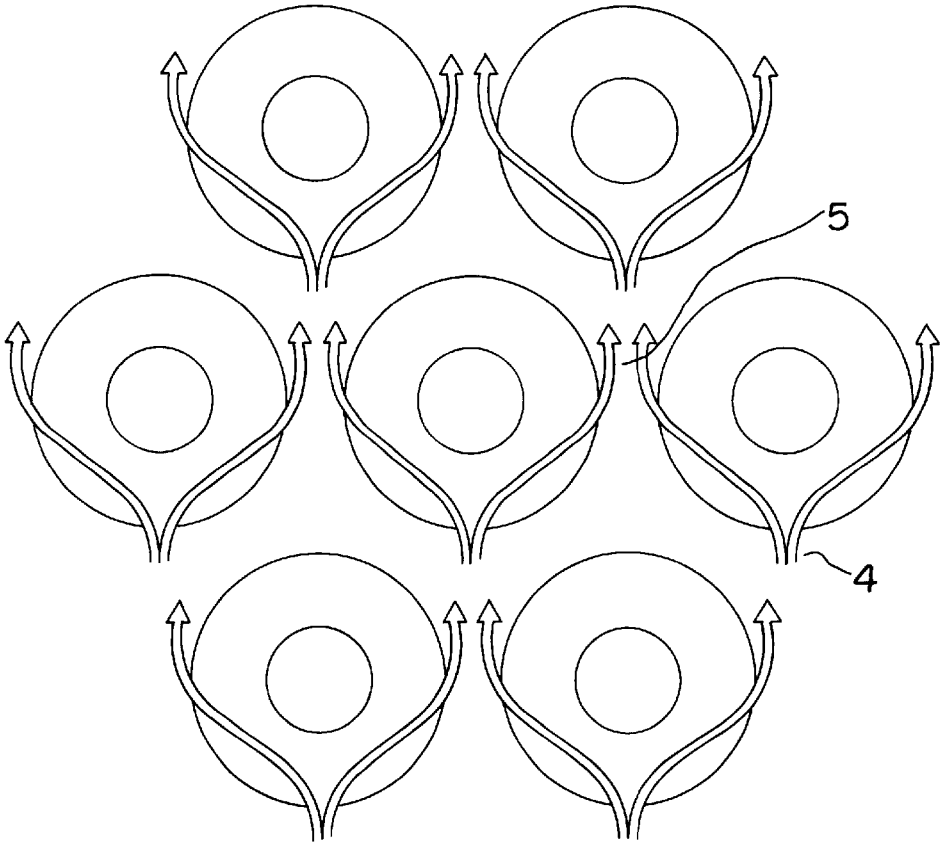
Figure 3:
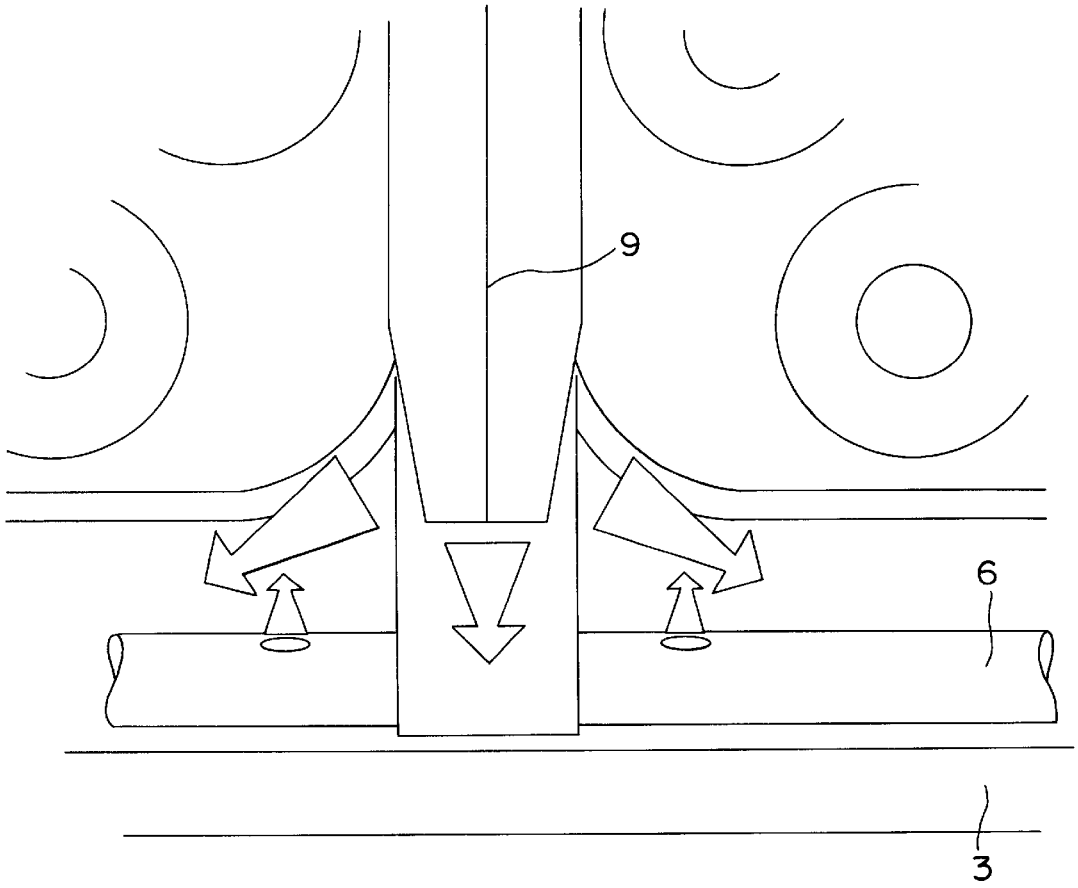
Figure 4:
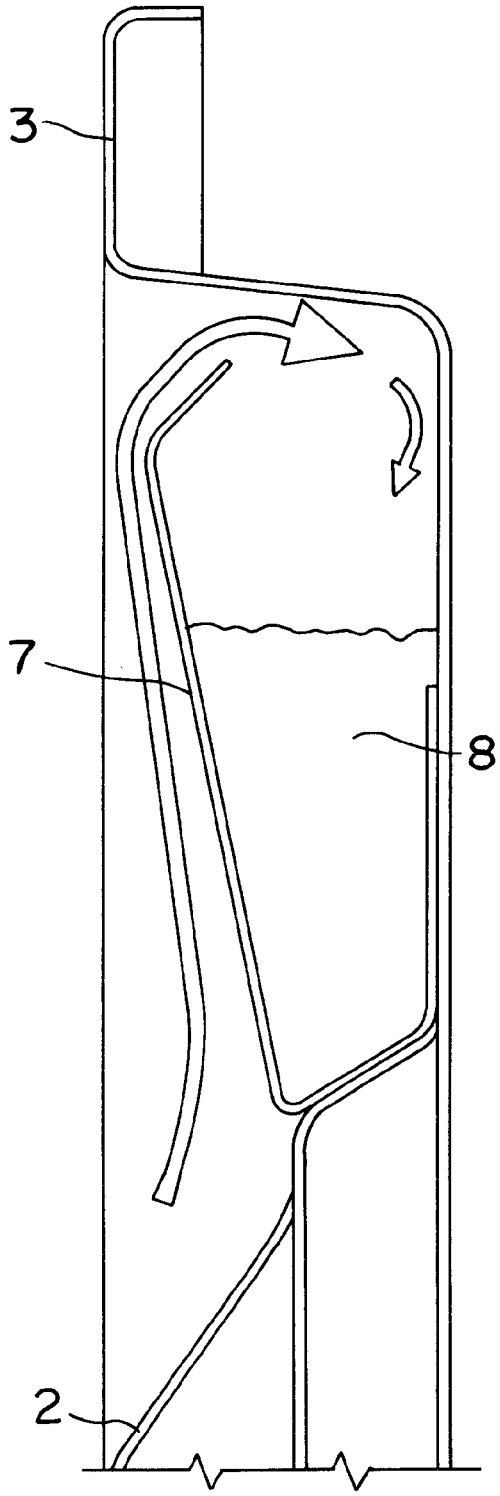
Figure 5:
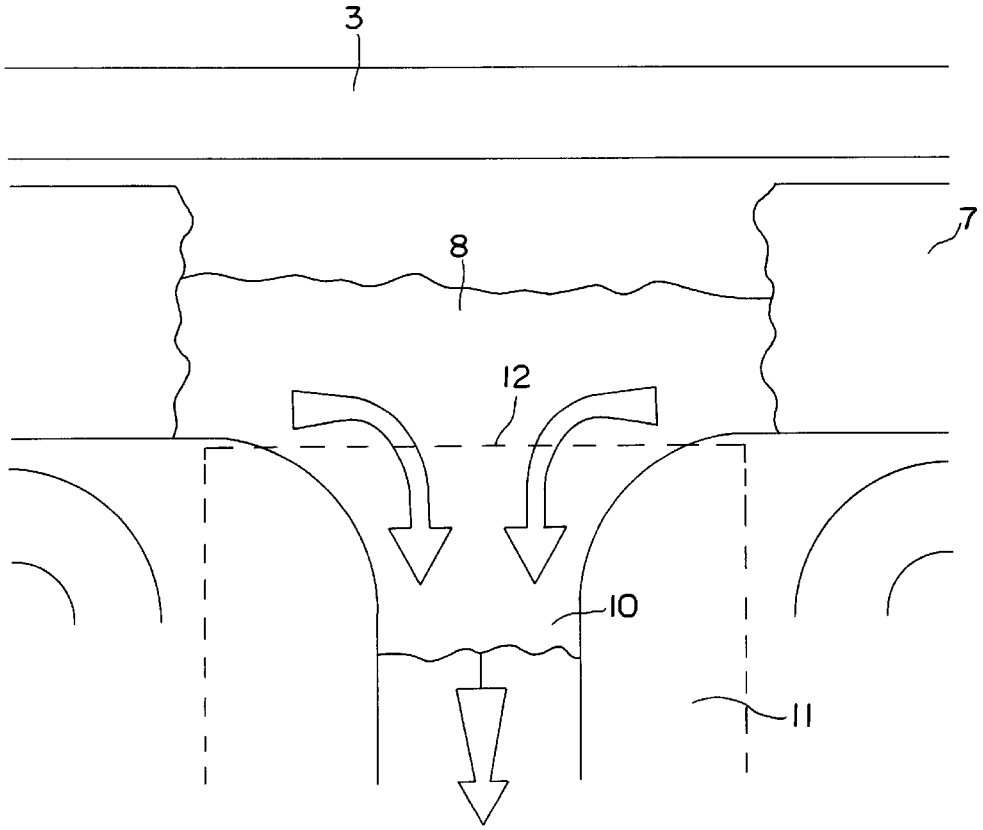
Figure 6:
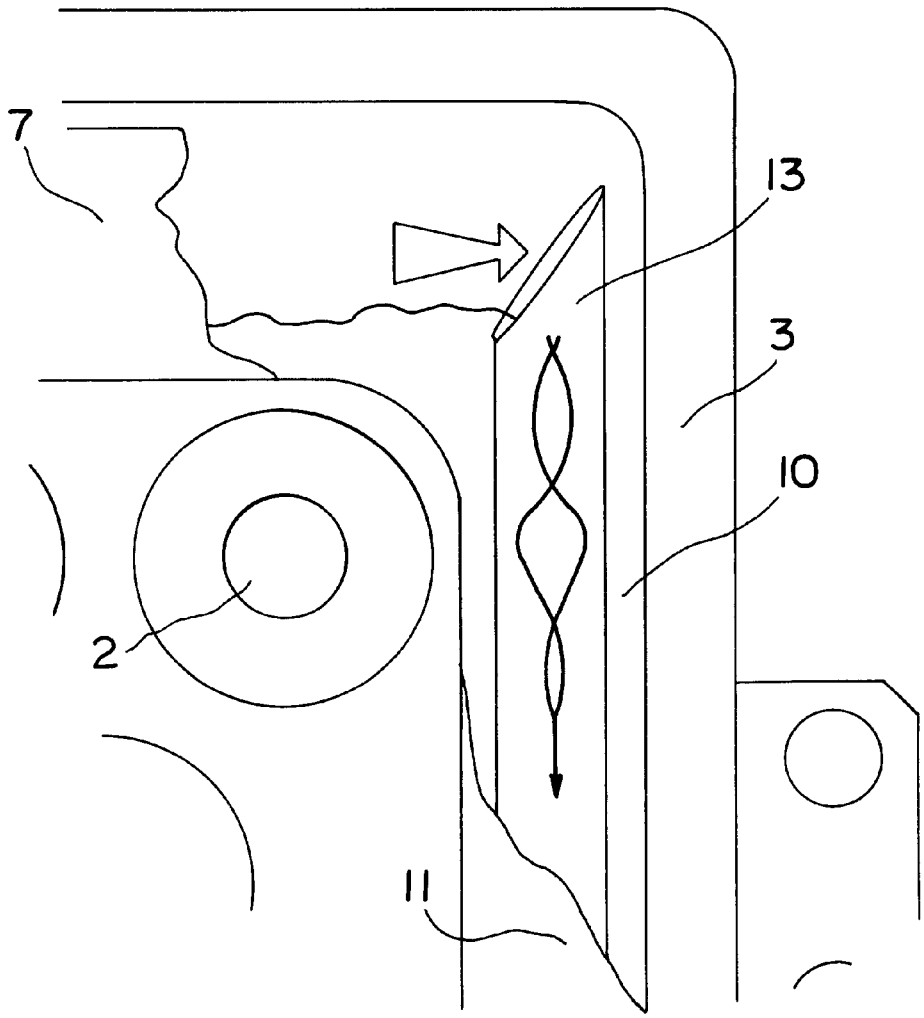
Figure 7:
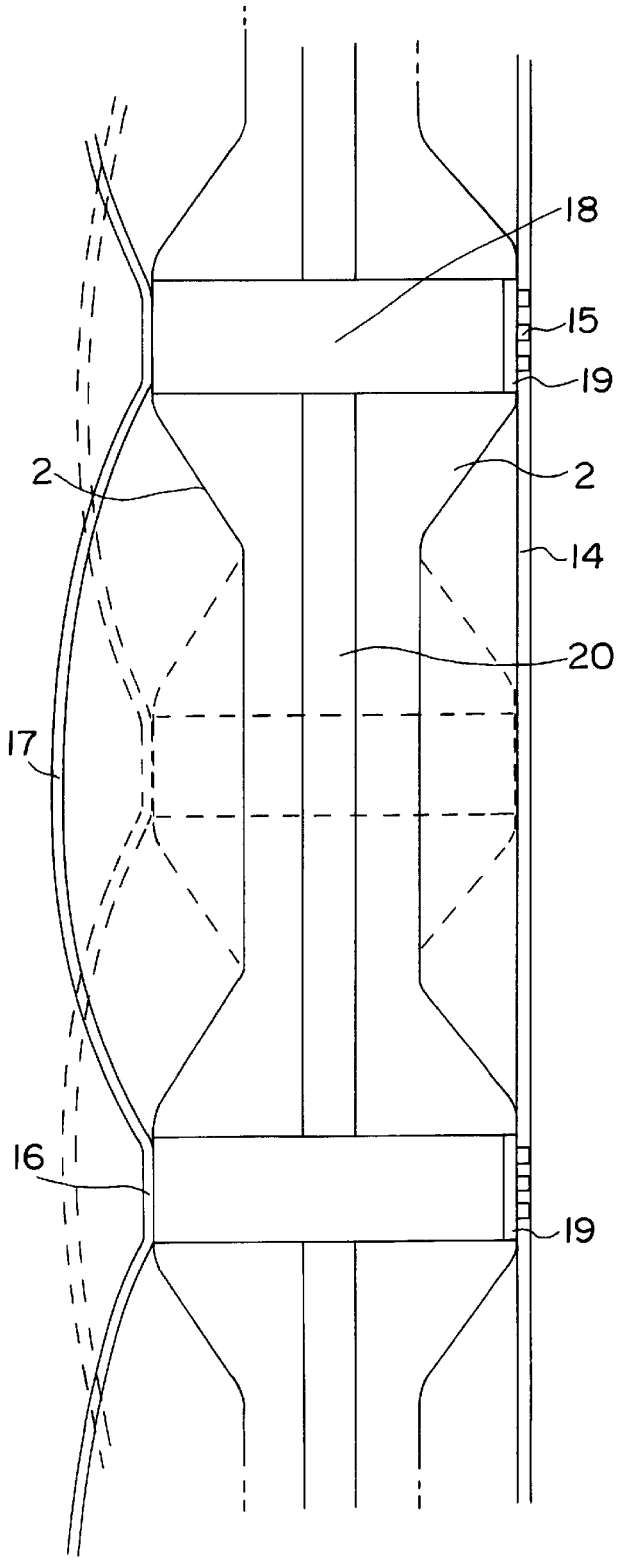
Figure 8A:
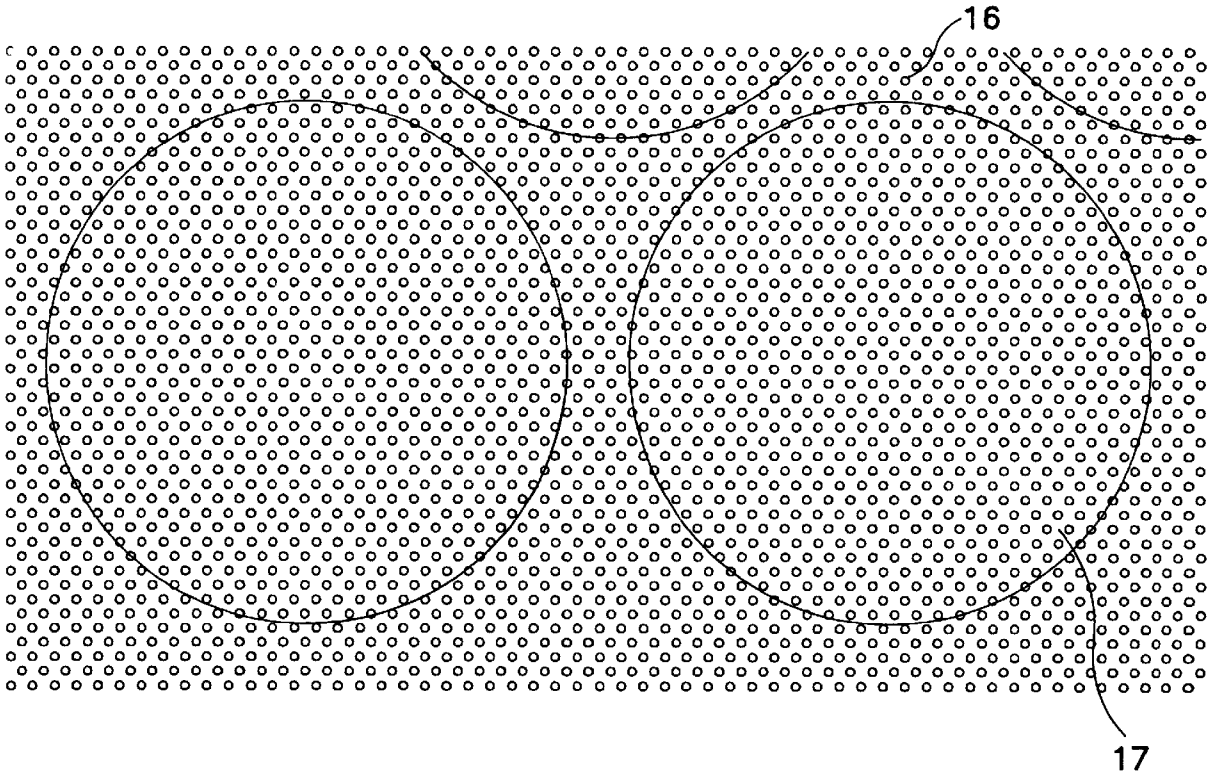
Figure 8B:
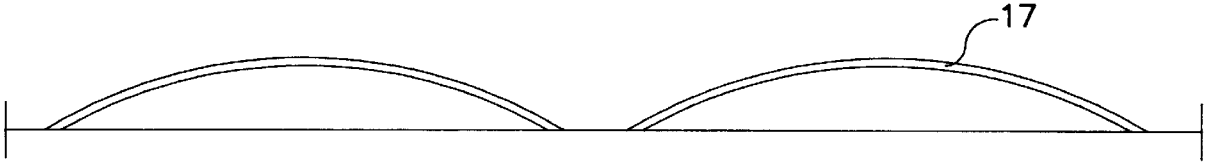
Figure 9:
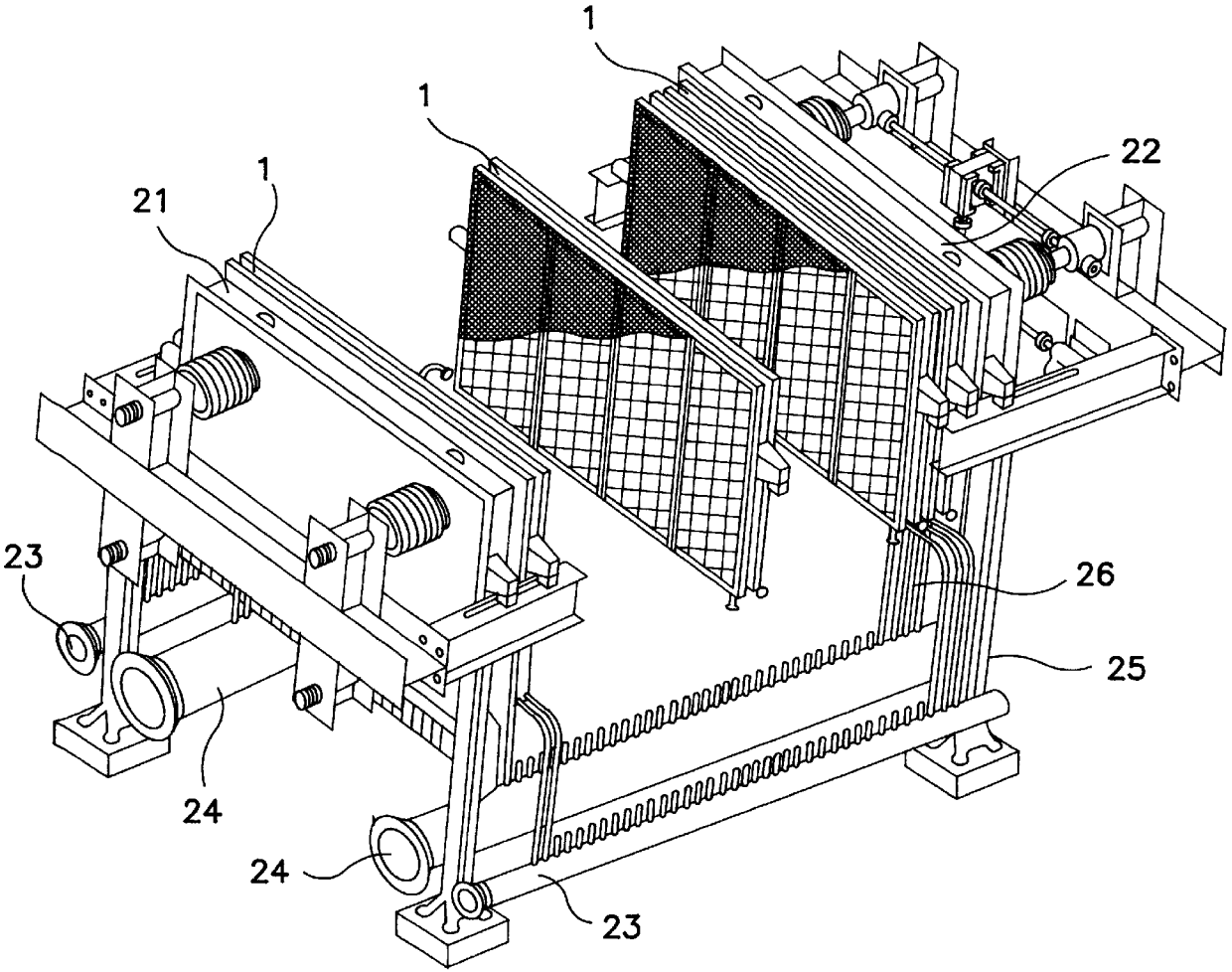
Figure 10:
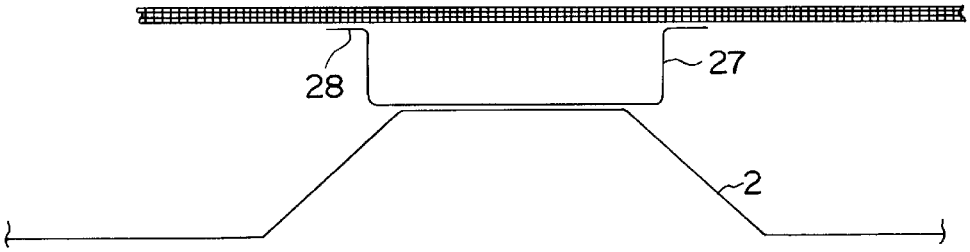
Figure 11:
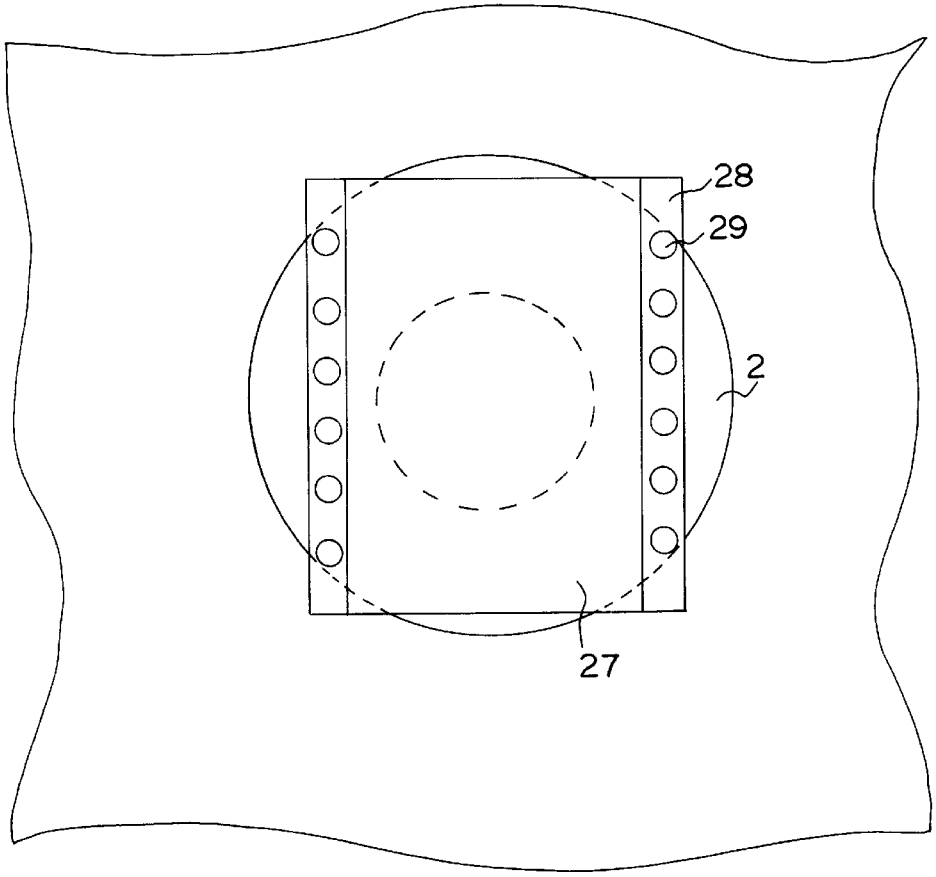
Figure 12:
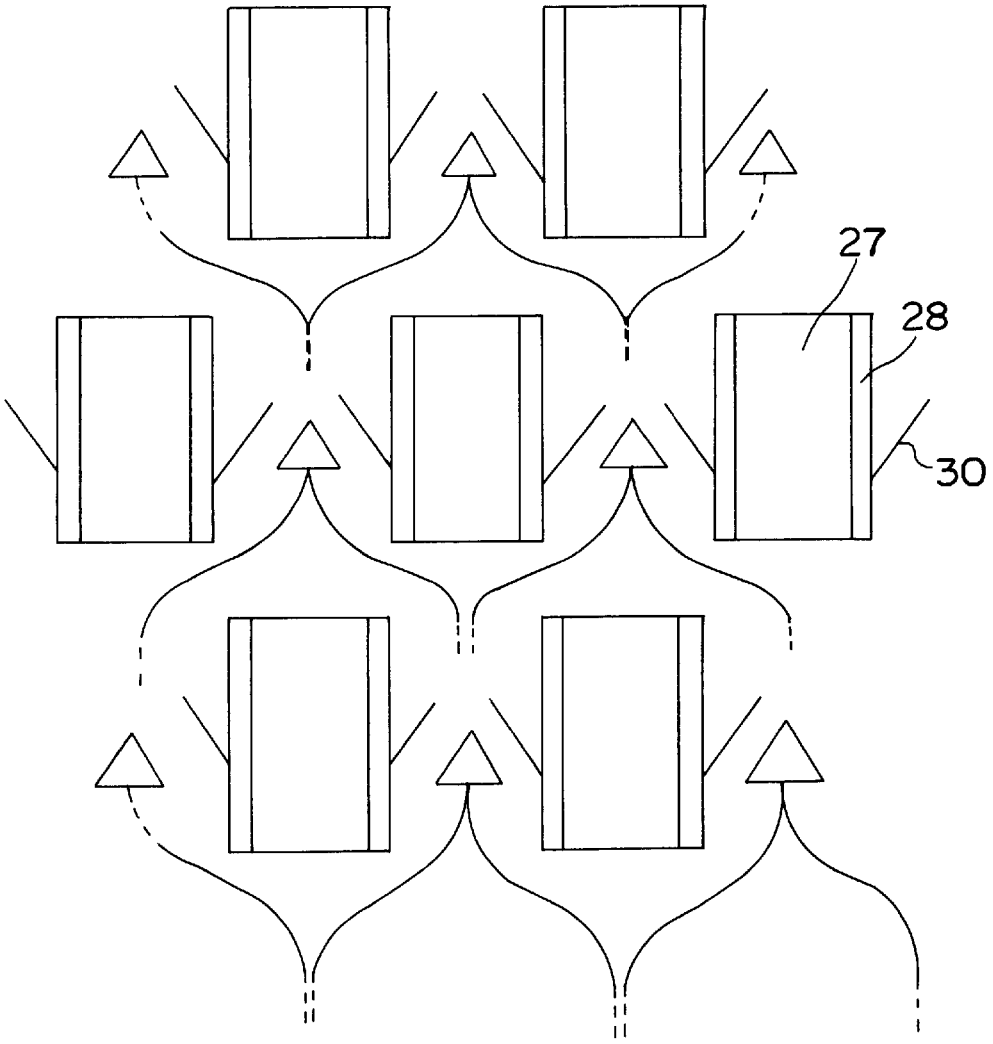

FIG. 2 is a front view of the truncated conical projections of the elements of the electrolyzer FIG. 3 is a partial front view of the distributor provided in the lower part of the elements of the electrolyzer FIG. 4 is a cross section of the baffle and upper flange for disengagement of the gaseous phase FIG. 5 shows a detail of the channel formed by the baffle and the element wall FIG. 6 shows the inlet of the discharge pipe FIG. 7 is a transversal horizontal cross-section of an element FIG. 8A) is a frontal view of the cathodic screen and FIG. 8B) is a cross-section thereof FIG. 9 is a view of the electrolyzer of the invention FIG. 10 is a cross section of the U-shaped conductive support FIG. 11 is a front view of another embodiment of the conductive support provided with holes FIG. 12 is a partial front view of an element of the electrolyzer.

DETAILED DESCRIPTION OF THE INVENTION

Making reference to FIG. 1 wherein, for simplicity sake, the electrodes are omitted, the structure of one side of the element 1 is shown. The two sides are made of two sheets cold-pressed in order to obtain the projections 2 and the peripheral flange 3 which ensures sealing thanks to a suitable gasket. In the case of chlor-alkali electrolysis, hereinafter referred to as an example, the two sheets are made of titanium and nickel. The projections are preferably in the form of a truncated cone and are preferably arranged according to a centered hexagonal configuration, as shown in FIG. 2. This geometry favours the transversal mixing of the electrolytes thanks to the deviation 4 and local flow crossing 5. The electrolyte is fed to the element through a distributor 6 provided with holes, not shown in FIG. 1 but illustrated in FIG. 3, which shows a detail of the lower part of element 1. The distributor 6 is housed in the lower part of element 1 along the internal edge of flange 3. The electrolyte and produced gas mixture is forced to flow to the upper part of the elements by an inclined baffle 7 which provides for collapsing the gas bubbles. The arrows shown in FIG. 3 indicate that the fresh electrolyte is efficiently mixed with the liquid coming from the downcomers 9. FIG. 4 schematizes by means of the arrows how the mixture of electrolyte and large gas bubbles overflows through the space comprised between the upper edge of the baffle and the lower edge of the flange in the channel behind the baffle itself, wherein the liquid and gaseous phases are quickly disengaged. With this type of recirculation, another important result is achieved, that is the electrolyte, although containing gas, reaches the flange edge and thus the membrane is substantially kept in contact with the liquid, avoiding the stagnation of gas pockets, which would embrittle the membrane and cause its rupture with time. As shown in FIG. 5 by the arrows, the electrolyte which is collected in the channel 8, formed by the baffle and the element wall, is nearly completely sent to the downcomers 9 formed by the depression 10 obtained in the sheet during cold-pressing of the projections 2. The depressions 10 are covered by elongated tiles 11 in order to form the downcomers 9. The elongated tiles 11 are represented by a dashed line for easier understanding of the drawing. The baffle 7 is suitably provided with holes 12 which coincide with the upper section of the downcomers 9. In this way a very efficient internal recirculation is obtained between the flow of the electrolyte-gas mixture uprising in the space comprised between the electrode and the cold-pressed element and the dowcoming flow of electrolyte containing no gas in the downcomers 9, as indicated by the arrows in FIG. 1. As the downcomers 9 are more than one, the cross-section available for the downcoming flow of the gas-free electrolyte may be as large as necessary, and the consequent flow of gas-free electrolyte is high. The energy necessary for the internal circulation is provided by the weight differential between the two fluid columns, electrolyte with gas and gas-free electrolyte respectively. It must be noted that all the parts necessary for the construction of the circulation system including the sheet with projections 2 and depressions 10, elongated tiles 11 and baffle 7 are cold-pressed and are easily inserted in place, optionally with fixing points, such as welding points. The gas-free electrolyte, collected in channel 8 and not recirculated through the downcomers 9 is withdrawn from the element by means of the internal discharge pipe 13 which crosses the lower flange and is connected through a suitable flexible joint to a manifold positioned under the electrolyzer. The pipe 13, omitted in FIG. 1, is shown in detail in FIG. 6. The arrows are used to schematize how by suitably tailoring diameter and the inlet shape of pipe 13, the electrolyte and gas discharge may take place without any pressure fluctuation. The discharge stability allows the liquid to flow without occluding completely the internal section of pipe 13. In this way a certain portion of the internal section of pipe 13 is always available for the continues discharge of gas. As previously said, FIG. 1 illustrates both the anodic and the cathodic sides of element 1. However, the two sides are different as regards the structure of the respective electrodes. FIG. 7 shows a transversal horizontal cross-section of an element. In this embodiment the anodic side is provided with a planar expanded titanium sheet 14 flattened only as far as necessary to eliminated the sharp asperities left by the expansion procedure. The expanded sheet is provided with an electrocatalytic coating for chlorine evolution, well known in the art and consisting of a mixture of oxides of metals of the platinum group and oxides of the so-called valve metals. The expanded sheet is fixed to the planar upper side of the truncated conical projections 2 by means of electric arc or resistance welding points. To avoid that the superimposed areas between the anode expanded sheet and the planar side of the truncated conical projections may become gas stagnation areas with the consequent damages for the membrane, the planar side of the truncated conical projections must be limited to the area necessary to provide for welding. Alternatively the anodic expanded sheet may be provided with grooves 15 on the side facing the membrane or alternatively on the face in contact with the planar side of the truncated conical projections. The grooves are vertically disposed and allow the gas to be discharged upwards, thus preventing the formation of stagnant gas pockets.

The cathode side of the elements is provided with a nickel screen 16 having an electrocatalytic coating for hydrogen evolution consisting of a mixture of an oxide of a metal of the platinum group and nickel oxide. In view of the high electrical conductivity of nickel, the cathode screen is considerably thinner than the anodic one. Due to this lower thickness, the mesh may be sufficiently flexible and elastic. The nickel mesh, before activation with the electrocatalytic coating and connection to the truncated conical projections, is cold-pressed in order to form bulges 17 rather large and not too deep, similar to spherical cups. A greater detail is given in FIG. 8, where A) represents a frontal view of the cathodic screen and B) a cross-section thereof The mesh or screen, activated by the electrocatalytic coating, is fixed onto the truncated conical projections in correspondence of the interspaces among the various bulges. As a consequence, the cathode surface is not planar as the one of the anode. Its profile is protruding, due to the bulges, with respect to the plane defined by the planar areas of the truncated conical projections. When the elements are pressed together, with the membrane and the gaskets between each couple of elements, to form an electrolyzer, the bulges are compressed against the membrane and the anode mesh or screen and undergo a deformation thanks to their elasticity. The resulting anode/membrane/cathode arrangement reaches a zero-gap configuration for at least 90% of its active surface. It is therefore possible to obtain a structure intrinsically not expensive, made of a thin nickel mesh with bulges connected to the planar portion of the truncated conical projections 2 by simple welding, eliminating the expensive and complicated elastic devices such as springs and mattresses used in the zero-gap arrangements of the prior art.

FIG. 7 clearly shows that the connection between the planar areas of the truncated conical projections 2 of the two sides of each bipolar element is made by interposing a connection element 18, for example a small cylinder made of conductive material, such as the cheap carbon steel. The element 18 is fixed by welding, for example by electrical resistance welding, directly on the cathode sheet made of nickel and interposing a compatible material 19 in contact with the anode sheet made of titanium. This material may be a titanium/carbon steel bi-metal obtained by explosion bonding and may have the form of a small disc. To make construction easier, the connection elements 18 are previously fixed to a supporting sheet 20 which is connected to an external frame interposed between the flanges 3 of the two sheets forming the two sides of each element 1. Assembling to this structure the cold-pressed anodic and cathodic sheets, each anodic projection 2 is easily connected to the corresponding cathodic projection 2, as well as a support is provided by the frame for the flanges 3. The electrical connection between the anodic and cathodic opposed projections may also be obtained by interposing between the two cold-pressed sheet a connection element consisting of a third sheet made of a highly conductive material, preferably copper, previously cold-press to form truncated conical projections having suitable dimensions to obtain a perfect matching with the anodic titanium sheet. The procedure for connecting the titanium/copper/nickel sheets is the same as that already illustrated for connection of the carbon steel cylinders. In this case electric current flows from the anodic sheet or screen 14 to the truncated conical projection 2 of the titanium sheet and to the copper sheet; while flowing through the copper sheet the current reaches to opposed truncated conical projection 2 of the nickel sheet and from there to the cathodic sheet or screen with bulges 17.

The elements of the invention are assembled to form an electrolyzer as shown in FIG. 9, comprising the pressing means 21 and 22 for pressing elements 1 against each other, the feeding and discharge collectors 23 and 24 respectively, and the connection pipes 25 and 26 for connecting elements 1 to collectors 23 and 24.

A further embodiment of the present invention is directed to provide an alternative solution to the problem of superimposing of the anodic mesh or screen and the planar surface of the truncated conical projections. To avoid occlusion of gases in this area, a conductive element may be interposed between the planar surface and the anodic mesh or screen. Said element may have different forms, for example it may be U-shaped as shown by reference numeral 27 of FIG. 10. The element 27 may be first connected to the planar surface of the truncated conical projections and it is then connected to the anodic mesh or screen.

FIG. 10 shows also a detail of the U-shaped element 27 which is bent to form two planar surfaces 28 which facilitate the connection of the mesh or screen, for example by welding points. The two surfaces 28, notwithstanding their limited dimensions, which should pose no problem of gas occlusion, can be provided with openings 29 in FIG. 11, to avoid any risk of occlusion. The element 27 permits to obtain the following advantages:

spacing of the membrane from the planar surface of the projections. As a consequence any defect in the membrane, with the migration of caustic soda from the cathodic compartment, does not cause corrosion of the anode sheet, with consequent leakage towards the outside.

Spacing of the membrane from the welding spots on the planar surface of the projections. These welding spots, which must be sufficiently strong and wide to grant for an easy flow of current, may have imperfections which could be dangerous for the integrity of the membrane. It is therefore possible to eliminate the post-welding quality controls, which are necessary if the anodic mesh or screen is directly applied onto the planar surfaces of the projections.

As the depth of the anode compartment is unchanged, the use of elements 27 permits to obtain less deep truncated conical projections with less critical cold-pressing techniques.

As the anodic and cathodic sheets are both provided with truncated conical projections, they may be obtained with a single mold and as a consequence also the projections of the cathodic sheet must be not too deep. Therefore, as the cathodic compartment has an unchanged depth, the same type of supports used for the anodic element must be used also for the cathodic side.

In another embodiment of the invention the projections may be eliminated on the anode and cathode side by suitably dimensioning the height of the supports as shown in FIG. 12, which is a partial view of an element of the electrolyzer. In this case the supports must be provided with suitable lateral baffles 30 which, as shown in FIG. 12 contribute to maintain the lateral mixing of the electrolytes similar to that provided by the truncated conical projections.

The connection between the anodic and cathodic sides may be the same as that illustrated in FIG. 7. Alternatively, in the absence of the truncated conical projections and with the reduced distance between the sheets, the connection may be obtained interposing between the sheets only the compatible material which is preferably a bi-metal of nickel/titanium obtained by colamination or optionally a titanium/nickel bi-metal obtained applying nickel by jet or plasma spray. The bi-metal may be in the form of a square or a disk, the same as that illustrated in FIG. 7, or as continuous strips. In this last case the connection may be by spot-welding, for example by electrical resistance, or continuous welding by a TIG or laser procedure. In both embodiments comprising or excluding the projections, the internal recirculation system remains the same, comprising the elongated tiles and downcomers, as previously described.

The invention will be better described making reference to an Example, which is not to be understood as a limitation of the same.

EXAMPLE

Three bipolar elements of the type described in FIG. 1 and two terminal elements, anodic and cathodic, were assembled to form a bipolar electrolyzer comprising four elementary cells. The active area of the elements was 140 cm×240 cm, for a total of 3.4 $m^2$ for each side. Each side of the elements was made of a cold pressed sheet made of titanium for the anodic side and of nickel for the cathodic side, provided with truncated conical projections having a base with 10 cm diameter and a the top planar surface of 2 cm diameter, the height being 2.5 cm. The distance among the center of the projections arranged in a centered hexagonal configuration was of 11 cm from each other. The internal conductive elements welded to the projections were made of carbon steel cylinders. Each cold-pressed sheet comprised also five depressions, two of them positioned close to the vertical edges, 5 cm wide. Each depression was covered with an elongated tile having the same width and positioned so as to form a dowcoming channel. One of the downcoming channels housed a discharge pipe with a 3 cm diameter, to release the liquid and gas phases (caustic soda and hydrogen for the cathode side and diluted brine and chlorine for the anode side respectively). The two sides of the elements comprised also a baffle positioned along the upper peripheral flange edge, as long as the element and 10 cm high. The cross-section available for the gas-liquid mixture flow between the upper edge of the baffle and the flange edge was 1 cm wide. The anode side of the elements was provided with a 0.1 cm thick expanded titanium sheet with hexagonal meshes, each mesh having a width of 0.3 cm and a length of 0.6 cm. The mesh was provided with an electrocatalytic film for chlorine evolution, made of mixed oxides of titanium, iridium and ruthenium, applied according to the teachings of U.S. Pat. No. 3,948,751, Example 3.

A nickel expanded sheet 0.05 cm thick, with rhomboidal openings having a 0.6 cm length and 0.3 cm width, was applied to the cathode side of the elements. The expanded sheet was formed by cold-pressing in order to form bulges with a 10 cm diameter and 0.2 cm height. The expanded sheet was further provided with an electrocatalytic coating for hydrogen evolution made of mixed oxides of nickel and ruthenium applied according to the teachings of U.S. Pat. No. 4,970,094, Example 1. The expanded sheet was connected to the cathode side by welding the planar surfaces comprised among the bulges to the planar surfaces of the truncated conical projections. The electrolyzer was operated with the following results:

recycle flow rate of the anolyte through the five downcoming channels of the anode sides: 2.3 and 2.8 $m^3$/hour/$m^2$ of membrane, at 5 and 8 kA/$m^2$ respectively.

recycle flow rate of the catholyte through the five downcoming channels of the anode sides: 2 and 2.4 $m^3$/hour/$m^2$ of membrane, at 5 and 8 kA/$m^2$ respectively.

anolyte concentration gradient with respect to the average value of 210 grams per liter (gpl): ±3 gpl. These data were obtained withdrawing liquid from suitable sampling points provided in the elements.

caustic soda concentration gradients with respect to the average value of 32%: ±0.2%.

temperature gradient with respect to the average value of 90° C.: +1, −2° C.

energy consumption: 2080 and 2280 kWh/ton of produced caustic soda at 4 and 6 kA/$m^2$. These values derive from cell voltages of 3.00 e 3.28 Volts, with faradic efficiencies of 96.5.

We claim:

1. An ion exchange membrane electrolyzer for the electrolysis of aqueous solution of electrolytes, made of a plurality of elementary cells, each cell delimited by a pair of elements and a pair of peripheral gaskets having an ion exchange membrane positioned in-between each of said elements comprising:

a pair of sheets provided with a peripheral flange suitable for housing the peripheral gaskets, a multiplicity of projections having a planar top, and vertical depressions a support frame interposed between the flanges of the two sheets conductive elements for the electrical connection of each projection of a sheet with the corresponding projection of the other sheet elongated tiles vertically positioned over the depressions to form downcoming ducts a baffle on the upper part of each sheet close but not in contact with the internal edge of the peripheral flange and provided with connection holes with each depression provided with the elongated tile a distributor for feeding the electrolyte aqueous solution positioned in the lower part of each sheet along the internal edge of the peripheral flange a vertical downcoming duct for the discharge of the exhausted aqueous solutions and of the electrolysis products an expanded sheet or mesh connected to the planar surface of the projections of each sheet, said expanded sheet or mesh provided with an electrocatalytic film for the electrochemical reaction.

2. The electrolyzer of claim 1 characterized in that the projections of the sheet have a truncated conical form.

3. The electrolyzer of claim 1 characterized in that the conductive elements have a cylindrical form.

4. The electrolyzer of claim 1 characterized in that the conductive elements are fixed to a sheet.

5. The electrolyzer of claim 4 characterized in that the sheet is integral to the support frame.

6. The electrolyzer of claim 1 characterized in that the conductive elements are represented by the projections cold-pressed in a conductive sheet.

7. The electrolyzer of claim 1 characterized in that the conductive elements are connected to the projections by welding.

8. The electrolyzer of claim 1 characterized in that the conductive elements are made of carbon steel, nickel or copper.

9. The electrolyzer of claim 1 characterized in that supports are inserted between the expanded sheets and the planar surface of the projections.

10. The electrolyzer of claim 9 where the supports are U-shaped.

11. The electrolyzer of claim 9 characterized in that the surfaces of said supports are provided with holes.

12. The electrolyzer of claim 1 characterized in that the projections of the sheets of the elements are arranged according to a hexagonal configuration.

13. The electrolyzer of claim 1 characterized in that the depressions of the sheets of the elements are equally spaced.

14. The electrolyzer of claim 1 characterized in that the distributors for feeding the electrolytes are ducts provided with holes.

15. The electrolyzer of claim 1 characterized in that the vertical downcoming discharge duct is housed inside the elements in one of the depressions of the sheet.

16. The electrolyzer of claim 1 characterized in that the element is of the bipolar type and the expanded mesh is made of activated nickel on the cathode side and activated titanium on the anode side.

17. The electrolyzer of claim 16 characterized in that the activated expanded mesh or sheet on the cathode side is provided with bulges.

18. The electrolyzer of claim 17 characterized in that the bulges have the form of a spherical cup.

19. The electrolyzer of claim 17 characterized in that the bulges are compressed against the ion exchange membrane.

20. The electrolyzer of claim 16 characterized in that the activated expanded mesh or sheet on the anode side is provided with grooves.

21. The electrolyzer of claim 16 characterized in that the expanded meshes or sheets have hexagonal openings.

22. The electrolyzer of claim 16 characterized in that the activated titanium expanded sheets or meshes on the anode side are provided with an electrocatalytic coating for chlorine evolution made of mixed oxides or valve metals and platinum group metals.

23. The electrolyzer of claim 16 characterized in that the activated nickel expanded sheets or meshes on the cathode side are made of nickel and provided with an electrocatalytic coating for hydrogen evolution.

24. The electrolyzer of claim 1 characterized in that the electrolyte aqueous solutions are solutions of sodium chloride and caustic soda.

25. The electrolyzer of claim 1 where the projections are manufactured separately and fixed to the sheets.

26. The electrolyzer of claim 25 where said fixed projections are U-shaped and are provided with lateral baffles for electrolyte mixing.

27. The electrolyzer of claim 26 where said fixed projections have their surfaces in contact with the expanded meshes or sheets and are provided with holes.

28. In a process for electrolysis of brine to form chlorine, hydrogen and caustic soda, the improvement comprising effecting the electrolysis in an electrolyzer of claim 1.

* * * * *